US011453024B2

(12) United States Patent
Vaughan

(10) Patent No.: US 11,453,024 B2
(45) Date of Patent: Sep. 27, 2022

(54) SPRINKLER ELEVATION DEVICE

(71) Applicant: Steinhardt Corporation Pty Ltd, Red Hill (AU)

(72) Inventor: John Vaughan, Red Hill (AU)

(73) Assignee: Steinhardt Corporation Pty Ltd., Queensland (AU)

( * ) Notice: Subject to any disclaimer, the term of this patent is extended or adjusted under 35 U.S.C. 154(b) by 0 days.

(21) Appl. No.: 17/097,367

(22) Filed: Nov. 13, 2020

(65) Prior Publication Data

US 2022/0016659 A1 Jan. 20, 2022

(30) Foreign Application Priority Data

Jul. 20, 2020 (AU) ..... 2020101416

(51) Int. Cl.
*B05B 15/65* (2018.01)
*B05B 15/628* (2018.01)
*B05B 15/622* (2018.01)

(52) U.S. Cl.
CPC ..... *B05B 15/65* (2018.02); *B05B 15/622* (2018.02); *B05B 15/628* (2018.02)

(58) Field of Classification Search
CPC ..... B05B 15/65; B05B 15/628; B05B 15/622
USPC ..... 239/273, 276, 280, 266–269, 542, 547; 248/75, 76, 80, 87; 47/48.5
See application file for complete search history.

(56) References Cited

U.S. PATENT DOCUMENTS 2,534,016 A * 12/1950 Grelson ..... B05B 3/06 239/276
4,944,476 A * 7/1990 Olson ..... E04H 15/62 248/87
5,158,231 A * 10/1992 Christen ..... A01G 25/00 239/276
5,261,607 A * 11/1993 Rosenberg ..... A01G 25/00 239/276
2004/0149835 A1* 8/2004 Zur ..... B05B 15/622 239/276

* cited by examiner

*Primary Examiner* — Steven J Ganey
(74) *Attorney, Agent, or Firm* — Fish & Richardson P.C.

(57) ABSTRACT

The present invention resides in a sprinkler elevation device comprising an elongate member having a first end comprising a ground engaging portion, and a second end comprising a sprinkler attachment portion, and a hose retaining member located on the elongate member. The present invention alleviates some the problems associated with presently available sprinkler systems.

11 Claims, 6 Drawing Sheets

SPRINKLER ELEVATION DEVICE

FIELD OF THE INVENTION

The present invention relates to the field of horticulture. More particularly, the invention relates to delivering water and/or nutrients to plants. Even more particularly, the invention relates to a sprinkler elevation device.

BACKGROUND TO THE INVENTION

Any reference to background art herein is not to be construed as an admission that such art constitutes common general knowledge in Australia or elsewhere.

Sprinklers are typically placed on the ground to deliver water and/or nutrients to a growing plant. Sprinklers can slowly release water and/or nutrients directly into the ground or, alternatively, sprinklers may be designed such that they expel water over a certain distance to deliver the water and/or nutrients to plants in the target area. Typically, the plants absorb water and/or nutrients through their root systems in the ground.

However, in some instances, sprinklers may need to be elevated above the ground to ensure adequate provision of the water and/or nutrients. One such plant that requires such a setup is a macadamia plant. In this regard, a sprinkler system is preferably maintained at a consistent height.

In order to solve this problem, a hose that delivers the water and/or nutrients to a connected sprinkler is supported by the macadamia tree itself (branches thereof). However, a disadvantage to this is that the weight of the hose, water and/or nutrients flowing therethrough, and that the sprinkler may be too great for the macadamia plant to support and cause a breakage in the branch. It should be apparent that it would be advantageous to address this issue as this results in damage and a reduction in harvest. Furthermore, the hose and/or sprinkler may require screws, nails, staples, wire rope, cable ties and/or a number of other tools in order for them to be secured to the plant. Once again, the use of these tools may be detrimental to the growth, and thus harvest of the plants.

Another method of solving this problem is to support the sprinklers on adjacent plants. In this regard, the hose and sprinkler may be secured to adjacent plants to alleviate the above issue. However, as with all agriculture set ups, space is at a premium and these additional plants can lead to a less efficient farm. Furthermore, these plants may also take up water and/or nutrients that were supposed to be delivered to the desired plant.

It should be apparent that it would be advantageous to alleviate one or more of the above issues, or to at least provide the consumer with a commercial alternative.

SUMMARY OF THE INVENTION

In one form, although it need not be the only or indeed the broadest form, the invention resides in a sprinkler elevation device comprising:

- an elongate member having a first end comprising a ground engaging portion, and a second end comprising a sprinkler attachment portion; and
- a hose retaining member located on the elongate member.

In one embodiment, the sprinkler elevation device further comprises a resilient portion on the first end. In further embodiments, the resilient portion comprises a head.

In embodiments, the sprinkler attachment portion comprises a sprinkler mounting pin, a support member and a surface. The sprinkler mounting pin is adapted to removably attach to a sprinkler. The surface extends away from the first end. The sprinkler mounting pin is connected to the surface. The support member is adapted to hold the sprinkler in the desired orientation.

In certain embodiments, the second end further comprises a second sprinkler attachment portion. The second sprinkler attachment portion comprises a second sprinkler mount pin, a second support member and a second surface. The second sprinkler mounting pin is adapted to removably attach to a sprinkler. The second surface extends away from the first end. The second sprinkler mounting pin is connected to the second surface. The second support member is adapted to hold the sprinkler in the desired orientation.

In embodiments, the sprinkler elevation device further comprises a notch that assists retaining a hose in the hose retaining member.

In an embodiment, the hose retaining member comprises a lower extent, an outer extent and an upper extent. The lower extent is connected to the elongate member. The lower extent is connected to the outer extent. The outer extent is connected to the upper extent. The upper extent extends away from the elongate member. In an embodiment, the hose retaining member is adjacent the sprinkler attachment portion. In an embodiment, the lower extent is a curved lower extent. In one embodiment, the outer extent is biased towards elongate member.

In one embodiment, the ground engaging member has a cross-shaped cross section. In an embodiment, the ground engaging portion comprises a pointed base.

In one embodiment, the elongate member has a length of at least about 300 mm, at least about 400 mm, at least about 500 mm, at least about 600 mm or at least about 700 mm. In an embodiment, the elongate member has a length of about 600 mm or about 700 mm.

In some embodiments, the sprinkler elevation device is integrally formed.

In some embodiments, the invention resides in the sprinkler elevation device when used with a sprinkler system. In some embodiments, the invention resides in the sprinkler elevation device for use with a sprinkler system.

In a second form, the invention resides in a method of elevating a sprinkler including the steps of:

- providing a sprinkler elevation device comprising an elongate member having a first end comprising a ground engaging portion, a second end comprising a sprinkler attachment portion, and a hose retaining member located on the elongate member;
- inserting the ground engaging portion into earth;
- attaching a sprinkler to the sprinkler attachment portion;
- retaining a hose connected in the sprinkler in the hose retaining member,
- to thereby elevate the sprinkler.

The sprinkler elevation device is as substantially described hereinabove for the first form.

The various features and embodiments of the present invention referred to in the individual sections above and in the description which follows apply, as appropriate, to other sections, mutatis mutandis. Consequently features specified in one section may be combined with features specified in other sections as appropriate.

Further features and advantages of the present invention will become apparent from the following detailed description.

BRIEF DESCRIPTION OF THE DRAWINGS

To assist in understanding the invention and to enable a person skilled in the art to put the invention into practical effect, embodiments of the invention will be described by way of example only with reference to the accompanying drawings, in which.

DETAILED DESCRIPTION OF THE INVENTION

Figure 1:
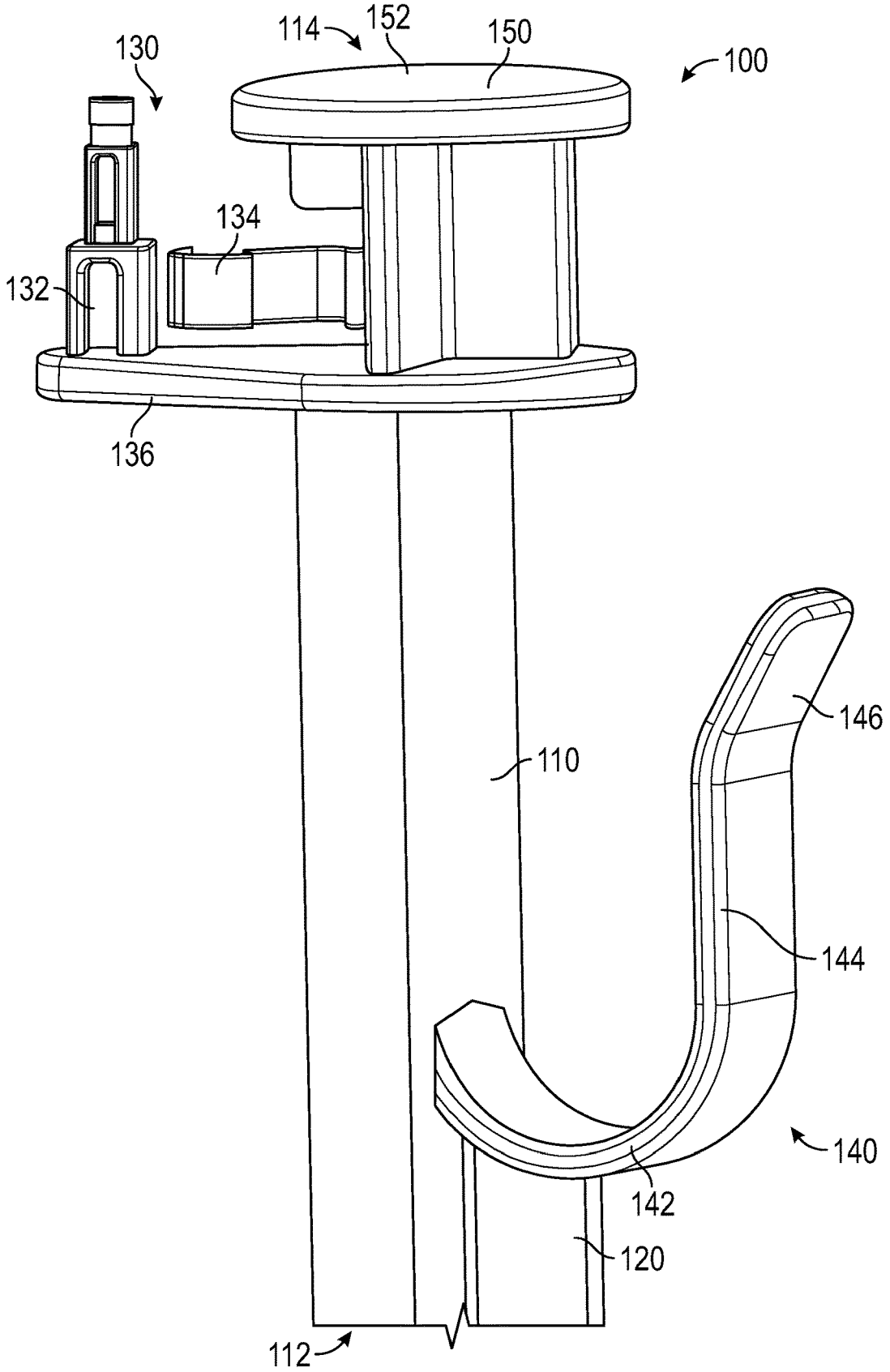
FIG. 1 is an embodiment of the sprinkler elevation device.

Embodiments of the present invention reside primarily in a sprinkler elevation device. Accordingly, the device and method steps have been illustrated in concise schematic form in the drawings, showing only those specific details that are necessary for understanding the embodiments of the present invention so as to not obscure the disclosure with excessive detail that will be readily apparent to those of ordinary skill in the art having the benefit of the present description.

In this specification, adjectives such as first and second, top and bottom, and the like may be used solely to distinguish one element or action from another element or action without necessarily requiring or implying any actual such relationship or order.

Words such as "comprises" or "includes" are intended to define a non-exclusive inclusion, such that a process, method, article, or apparatus that comprises a list of elements does not include only those elements but may include other elements not expressly listed, including elements that are inherent to such a process, method, article, or apparatus.

As used herein, the term 'about' means the amount is nominally the number following the term 'about' but the actual amount may vary from this precise number to an unimportant degree.

The present invention is predicated on the finding that the provision of a sprinkler elevation device alleviates the problems mentioned hereinabove. In this regard, the present invention allows for a sprinkler to be easily elevated to the desired height without retaining them on the plants themselves, adjacent plants or cumbersome large physical structures.

In a first aspect, although it need not be the broadest or indeed the only aspect, the invention resides in a sprinkler elevation device comprising:

an elongate member having a first end comprising a ground engaging portion, and a second end comprising a sprinkler attachment portion; and a hose retaining member located on the elongate member.

The sprinkler elevation device allows for a sprinkler system (typically comprising a hose and at least one sprinkler) to be raised easily. In this regard, the ground engaging portion is adapted to engage the ground to stably support the sprinkler elevation device (and associated attached sprinkler) at the desired height and orientation. The sprinkler attachment portion is adapted to removably attach to a sprinkler. The sprinkler attachment portion maintains the sprinkler in the desired orientation. The hose retaining member is adapted to hold the hose that delivers water and/or nutrients to the sprinkler. Typically, the hose delivers the water and/or nutrients to the sprinkler via a secondary hose of fixed length. The hose retaining member ensures that the hose is supported at a suitable distance from the sprinkler such that strain is not placed on the secondary hose. This alleviates the problem of the hose being disconnected or severed from the sprinkler.

FIG. 1 shows an embodiment of a sprinkler elevation device 100. The sprinkler elevation device 100 comprises an elongate member 110 having a first end 112 and second end 114. The first end 112 comprises a ground engaging portion 120. The second end 114 comprises a sprinkler attachment portion 130. The sprinkler elevation device 100 also comprises a hose retaining member 140 connected or attached to the elongate member 110. In one embodiment, the elongate member 110 defines an axis (central of the elongate member).

It should be appreciated that FIG. 1 shows an enlarged view of the sprinkler attachment portion 130 and hose retaining member 140. In this regard, the ground engaging portion 120 of elongate member 110 is shown cut-off. That is, the ground engaging portion 120 may have a larger length than shown. In this regard, it will be appreciated that the elongate member 110 may be of any length desirable. In one embodiment, the elongate member has a length of at least about 300 mm, at least about 400 mm, at least about 500 mm, at least about 600 mm or at least about 700 mm. In an embodiment, the elongate member has a length of about 600 mm or about 700 mm.

The ground engaging portion 120 is shaped to stably engage the earth. In the embodiment shown, the ground engaging portion 120 has a cross-shaped cross-section (e.g., shown in FIG. 1). It will be appreciated that the ground engaging portion 120 may have a pointed base to assist in engaging earth or ground. In one embodiment, the ground engaging portion 120 is in the form of a stake (shown in a later figure). The cross-shaped cross-section and pointed base facilitate insertion of the ground engaging member 120 into the ground.

Figure 3:
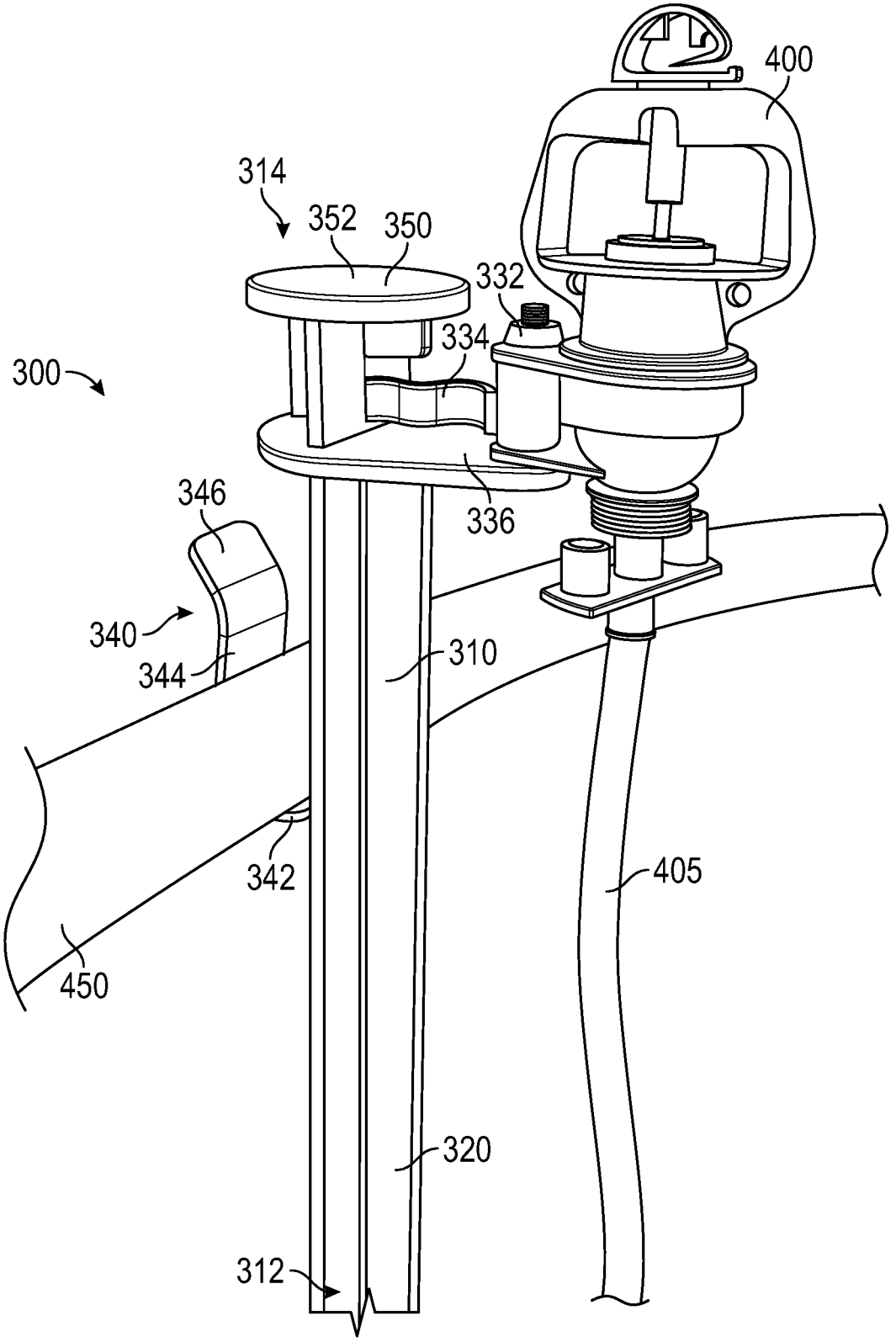
FIGS. 3-5 show a number of views of an embodiment of the sprinkler elevation device in combination with a sprinkler and hose.
Figure 4:
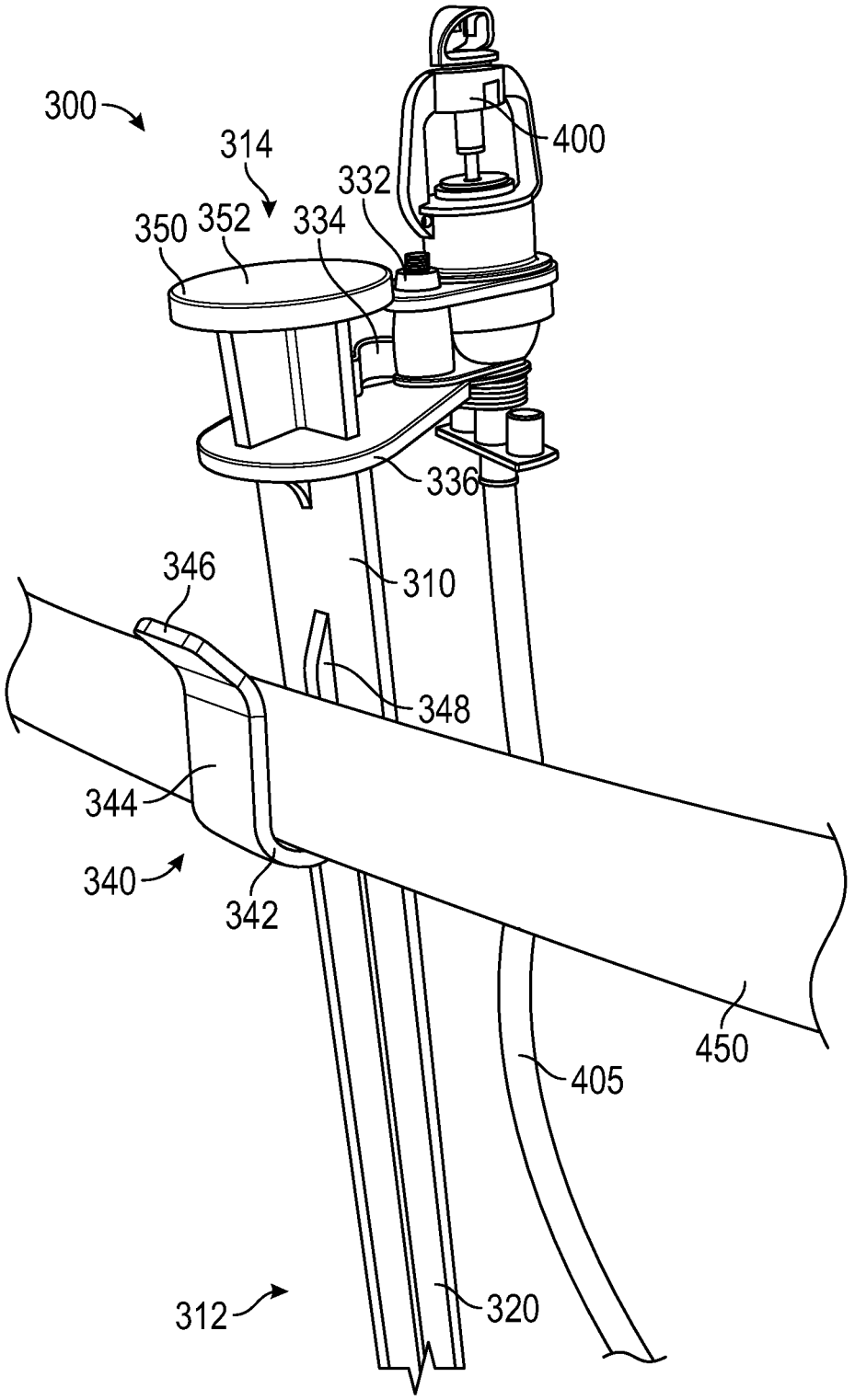
Figure 5:
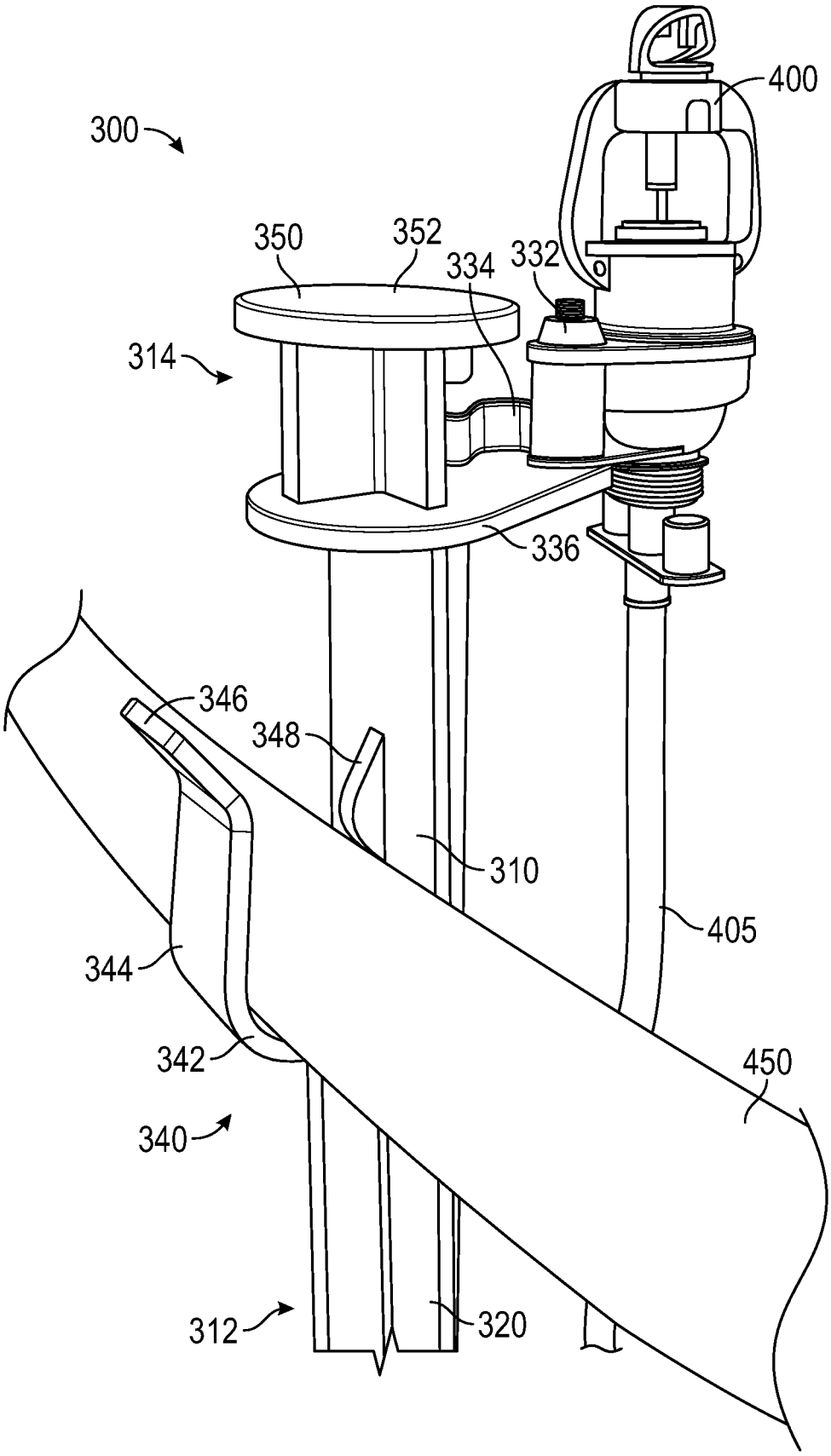

As mentioned above, the ground engaging portion 120 is shown cut-off. In this regard, it will be appreciated that the ground engaging portion 120 may be of a longer length as shown in the later figures. In this regard, FIGS. 3-5 show an embodiment of the sprinkler elevation device where the ground engaging portion 120 is shown to have a longer length.

The sprinkler attachment portion 130 is adapted to removably attach to a sprinkler. In the embodiment shown, the sprinkler attachment portion 130 comprises a sprinkler mounting pin 132. The sprinkler mounting pin 132 allows a sprinkler to be mounted thereto. The sprinkler mounting pin 132 may be mounted on a surface 136 extending from the second end 114 of the elongate member 110. In one embodiment, the surface 136 is perpendicular to the axis defined by the elongate member 110.

The sprinkler attachment portion 130 may further comprise a supporting member 134. The supporting member 134 engages the sprinkler attached to the sprinkler mounting pin 132 and stabilizes and secures it during a sprinkling operation.

The hose retaining member 140 is adapted to retain a hose. The hose carries water and/or nutrients. The hose is in fluid communication with the sprinkler such that the water and/or nutrients are delivered thereto. The hose retaining member 140 comprises a lower extent 142 connected to the elongate member 110. In one embodiment, the lower extent 142 is a curved lower extent. The lower extent 142 is connected to an outer extent 144. In the embodiment shown, the outer extent 144 is generally parallel to the longitudinal axis of the elongate member 110. The outer extent 144 is connected to an upper extent 146. In the embodiment shown, the upper extent 146 extends away from the elongate member 110. The upper extent 146 facilitates placement of the hose in the hose retaining member 140. As shown, the elongate member 110 and hose retaining member 140 generally define a 'U' shape to retain a hose therein. The hose retaining member 140 is located between the first end 112 and second end 114 of the elongate member 110. In one embodiment, the hose retaining member 140 is connected to the elongate member 110 towards the second end 114. In an embodiment, the hose retaining member 140 is connected to the elongate member 110 adjacent the sprinkler attachment portion 130.

The sprinkler elevation device 100 may further comprise a resilient portion 150. The resilient portion 150 is suitably located on the second end 114. The resilient portion 150 is adapted to receive a force to assist in pushing the ground engaging member 120 into the ground or earth. The resilient portion 150 suitably comprises a head 152. The head 152 is supported by the elongate member 110. The force applied to the head 152 is transferred to the elongate member 110 to push the ground engaging portion 120 into the ground. For instance, a user may utilize a hammer or similar device to push the sprinkler elevation device 100 into the ground or earth, such that it is stably supported in the desired orientation.

Figure 2:
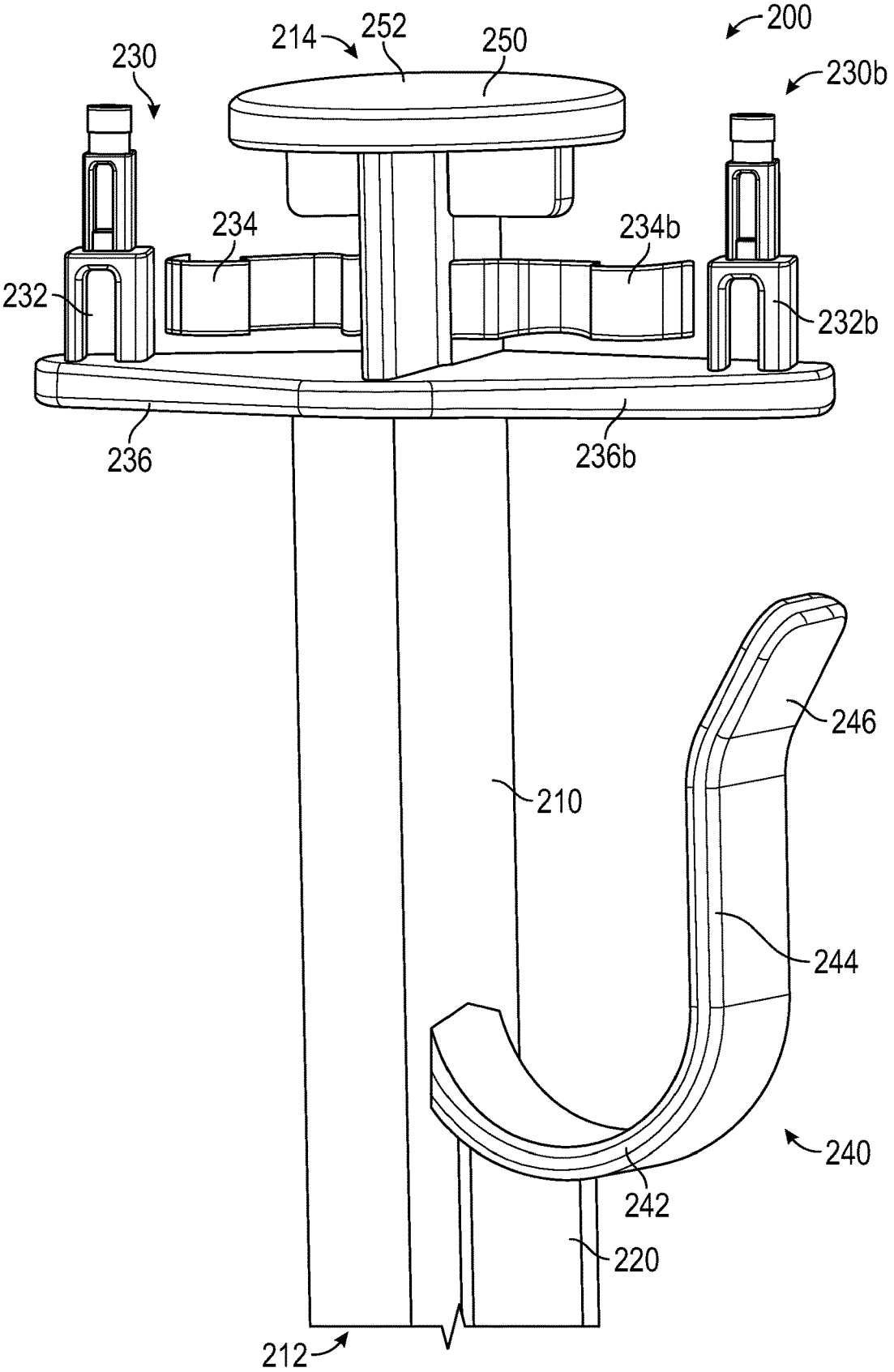
FIG. 2 is another embodiment of the sprinkler elevation device.

Shown in FIG. 2 is another embodiment of the sprinkler elevation device. Similar to the sprinkler elevation device 100 described hereinabove in relation to FIG. 1, the sprinkler elevation device 200 comprises an elongate member 210 having a first end 212 and second end 214. The first end 212 comprises a ground engaging portion 220. The second end 214 comprises a sprinkler attachment portion 230. The sprinkler elevation device 200 also comprises a hose retaining member 240 connected or attached to the elongate member 210. The sprinkler elevation device 200 also comprises a resilient portion 250.

The sprinkler attachment portion 230 comprises a sprinkler mounting pin 232, a support member 234 and surface 236. The hose retaining member comprises a lower extent 242, outer extent 244 and upper extent 246. The resident portion 250 comprises a head 252.

The sprinkler elevation device 200 and features thereof are as substantially described hereinabove for sprinkler elevation device 100 and features thereof.

One difference between the sprinkler elevation device 100 and sprinkler elevation device 200 is the additional sprinkler attachment portion **230*b*. In this regard, the second end 214 further comprises a second sprinkler attachment portion 230*b*. The second sprinkler attachment portion 230*b* is adapted to be removably attached to a second sprinkler. The second sprinkler attachment portion 230*b* comprises a second sprinkler mounting pin 232*b*. The second sprinkler mounting pin 232*b* allows a second sprinkler to be mounted thereto. The second sprinkler mounting pin 232*b* may be mounted on a second surface 236*b* extending from the elongate member 210**.

The second sprinkler attachment portion **230*b* may further comprise a second supporting member 234*b*. The second supporting member 234*b* engages the second sprinkler removably attached to the second sprinkler mounting pin 232 and stabilizes it during a sprinkling operation. In the embodiment shown, the second sprinkler attachment portion 230*b* extends in the opposite direction to the sprinkler attachment portion 230**.

It will be appreciated by the person skilled in the art that the sprinkler elevation device need not necessarily be limited to being adapted to attached to one or two sprinklers, but may be adapted to attach to three or four sprinklers. The person skilled in the art will appreciate that the sprinkler elevation device may comprise any number of sprinkler attachment portions. In one embodiment, the sprinkler elevation device comprises 1, 2, 3 or 4 sprinkler attachment portions. An advantage of this set up is that a single hose can deliver water and/or nutrients to multiple sprinklers, which allows for an easier set up. Furthermore, multiple adjacent plants may be watered simultaneously, leading to a less labour intensive and efficient process.

FIGS. 3-5 show a number of views of an embodiment of a sprinkler elevation device 300 in use with an exemplary sprinkler system. The exemplary sprinkler system comprises a sprinkler 400 in fluid communication with a hose 450 via a secondary hose 405.

Similar to the sprinkler elevation device 100 described hereinabove in relation to FIG. 1, the sprinkler elevation device 300 comprises an elongate member 310 having a first end 312 and second end 314. The first end 312 comprises a ground engaging portion 320. The second end 314 comprises a sprinkler attachment portion 330. The sprinkler elevation device 300 also comprises a hose retaining member 340 connected or attached to the elongate member 310. The sprinkler elevation device 300 also comprises a resilient portion 350.

The sprinkler attachment portion 330 comprises a sprinkler mounting pin 332, a support member 334 and surface 336. The hose retaining member comprises a lower extent 342, outer extent 344 and upper extent 346. The resilient portion 350 comprises a head 352.

The sprinkler elevation device 300 and features thereof are as substantially described hereinabove for sprinkler elevation device 100 and features thereof.

One difference between the sprinkler elevation device 100 described hereinabove in relation to FIG. 1 and the sprinkler elevation device 300 is that the elongate member 310 comprises a notch 348. In one embodiment, the elongate member comprises a notch. The notch 348 is connected or attached to the elongate member 310. As can be seen, the notch 348 cooperates with the hose retaining member 340 and the elongate member 110 to retain the hose 450. In this regard, the notch 348 assists in securing the hose. The notch 348 alleviates the problem of the hose 450 accidentally being dislodged from the hose retaining member 340. In one embodiment, the outer extent 344 may be biased towards elongate member 310 to further secure the hose.

Figure 6:
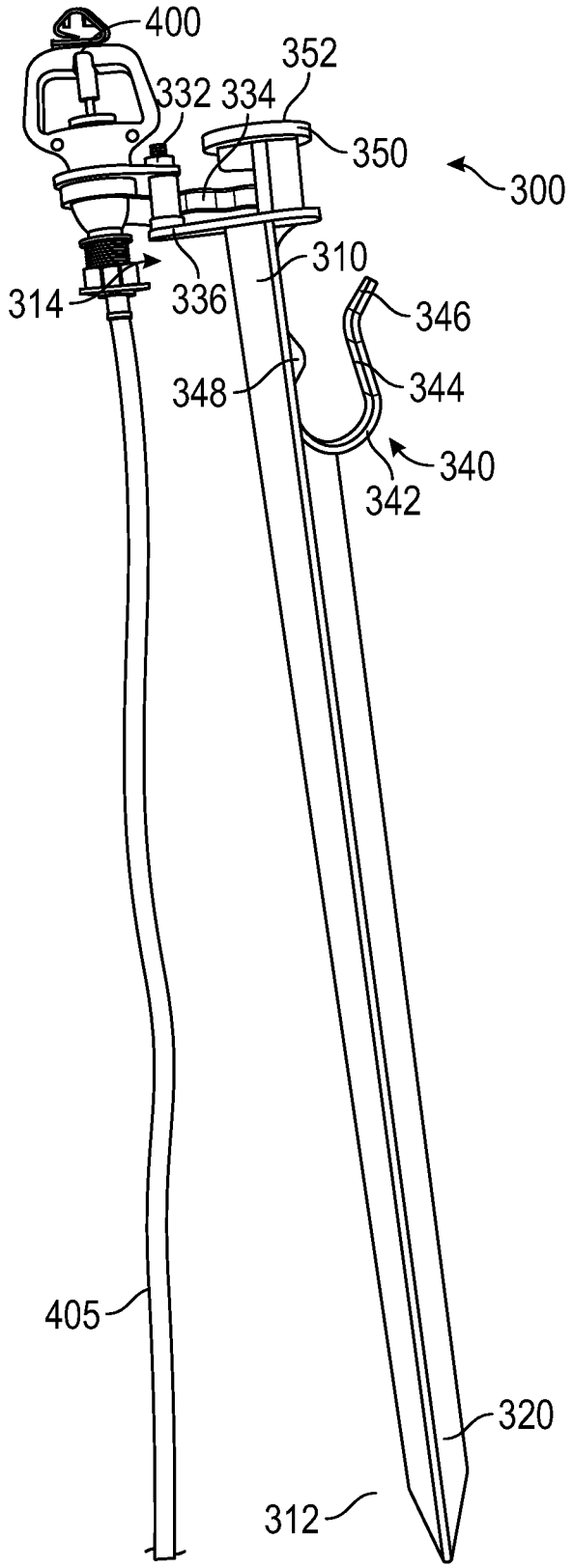
FIG. 6 shows an entire perspective view of an embodiment of the sprinkler elevation device in FIGS. 3-5 in combination with a sprinkler.

FIG. 6 shows an entire perspective view of an embodiment of sprinkler elevation system 300 attached to a sprinkler 400 without a hose for exemplification purposes.

The ground engaging portion (shown in FIG. 6) stably engages the earth to support the sprinkler elevation device in the desired orientation and height. The ground engaging portion may be suitably of any length so that the consumer can adjust the height of the sprinkler by adjusting how deep into the ground the ground engaging portion engages.

Multiple sprinkler elevation devices may be utilized with a single sprinkler system. In this regard, a sprinkler system typically has a plurality of sprinklers connected to the hose and are spaced apart at regular intervals. Each sprinkler may be elevated to the desired height by using a sprinkler elevation device. Furthermore, different sprinklers in the sprinkler system may be adjusted to be at different heights depending on the plant being watered. It will be appreciated that this allows for a sprinkler system to be elevated to the desired height without relying on the plant to be treated to support the sprinkler system or adjacent plants.

The sprinkler elevation device described herein may also be retrofitted to presently available sprinkler systems. In this regard, sprinkler systems that are currently available may be connected to the present sprinkler elevation device. This allows for greater flexibility of sprinkler systems, and reduces the economic costs to the consumer and to the environment.

The present invention allows for sprinkler systems to be raised to the desired height and orientation without the need to support them on plants or permanent physical structures. In this regard, as plants grow the location of the sprinkler system may need to be moved to ensure adequate delivery of water and/or nutrients thereto. The present sprinkler elevation device can be easily moved from location to location.

In one embodiment, the sprinkler elevation device is integrally formed. As used herein, the term 'integrally formed' refers to the formation of the sprinkler elevation device from a unitary piece of material.

In another aspect, the invention resides in a method of elevating a sprinkler including the steps of:

providing a sprinkler elevation device comprising an elongate member having a first end comprising a ground engaging portion, a second end comprising a sprinkler attachment portion, and a hose retaining member located on the elongate member;

inserting the ground engaging portion into earth;

attaching a sprinkler to the sprinkler attachment portion;

retaining a hose connected in the sprinkler in the hose retaining member, to thereby elevate the sprinkler.

The sprinkler elevation device is as substantially described hereinabove.

The sprinkler elevation device is typically inserted into the ground to stably secure it in the desired orientation. The user can insert the ground engaging portion into the earth to the desired depth such that the sprinkler attachment portion (and thus the sprinkler attached thereto) is at the desired elevation. The hose that delivers water and/or nutrients to the sprinkler is then retained in the hose retaining member, and the sprinkler is then be attached to the sprinkler attachment portion.

It will be appreciated that the method need not be completed in the above sequence, and may be completed by either retaining the hose in the hose retaining member or attaching a sprinkler to the sprinkler attachment portion and then inserting the ground engaging portion of the sprinkler elevation device into earth or ground.

Once the sprinkler elevation device has been elevated, water and/or nutrients may be delivered through the hose to a sprinkler. The sprinkler then expels the water and/or nutrients to the desired plants in the target area.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this invention is intended to embrace all alternatives, modifications and variations of the present invention that have been discussed herein, and other embodiments that fall within the spirit and scope of the above described invention.

The invention claimed is:

1. A sprinkler elevation device comprising:

an elongate member having a first end comprising a ground engaging portion, and a second end comprising a sprinkler attachment portion; and a hose retaining member located on the elongate member, wherein the hose retaining member comprises a lower extent connected to the elongate member, an outer extent connected to the lower extent, and an upper extent connected to the outer extent.

2. The sprinkler elevation device of claim 1, wherein the sprinkler elevation device further comprises a resilient portion on the second end.

3. The sprinkler elevation device of claim 1, wherein the second end further comprises a second sprinkler attachment portion.

4. The sprinkler elevation device of claim 1, wherein the sprinkler elevation device further comprises a notch that assists in retaining a hose in the hose retaining member.

5. The sprinkler elevation device of claim 1, wherein the outer extent is biased towards the elongate member.

6. The sprinkler elevation device of claim 1, wherein the hose retaining member is located between the first end and the second end.

7. The sprinkler elevation device of claim 6, wherein the hose retaining member is located adjacent the sprinkler attachment portion.

8. The sprinkler elevation device of claim 1, wherein the sprinkler attachment portion comprises a sprinkler mounting pin, a support member and a surface.

9. The sprinkler elevation device of claim 1, wherein the sprinkler elevation device is integrally formed.

10. The sprinkler elevation device of claim 1, wherein the elongate member has a length of at least about 300 mm, at least about 400 mm, at least about 500 mm, at least about 600 mm or at least about 700 mm.

11. A method of elevating a sprinkler including the steps of:

providing a sprinkler elevation device comprising an elongate member having a first end comprising a ground engaging portion, a second end comprising a sprinkler attachment portion, and a hose retaining member located on the elongate member, wherein the hose retaining member comprises a lower extent connected to the elongate member, an outer extent connected to the lower extent, and an upper extent connected to the outer extent;

inserting the ground engaging portion into earth;

attaching a sprinkler to the sprinkler attachment portion; and retaining a hose connected in the sprinkler in the hose retaining member, to thereby elevate the sprinkler.

* * * * *